US008668508B2

(12) United States Patent
Kiryu et al.

(10) Patent No.: US 8,668,508 B2
(45) Date of Patent: Mar. 11, 2014

(54) CONNECTOR

(75) Inventors: Koichi Kiryu, Nagano (JP); SeungSeok Beak, Tokyo (JP); Kimiyo Takahashi, Nagano (JP); Mitsuru Kobayashi, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 2 days.

(21) Appl. No.: 13/489,788

(22) Filed: Jun. 6, 2012

(65) Prior Publication Data

US 2013/0005187 A1 Jan. 3, 2013

(30) Foreign Application Priority Data

Jun. 29, 2011 (JP) ..... 2011-144952

(51) Int. Cl.
*H01R 13/629* (2006.01)

(52) U.S. Cl.
USPC ..... 439/248; 439/74

(58) Field of Classification Search
USPC ..... 439/247, 248, 74
See application file for complete search history.

(56) References Cited

U.S. PATENT DOCUMENTS

| | | | | |
|---|---|---|---|---|
| 5,201,663 | A * | 4/1993 | Kikuchi et al. | 439/83 |
| 7,374,432 | B2 * | 5/2008 | Koguchi et al. | 439/74 |
| 2011/0294326 | A1 * | 12/2011 | Tanaka et al. | 439/248 |
| 2013/0005187 | A1 * | 1/2013 | Kiryu et al. | 439/626 |
| 2013/0110459 | A1 * | 5/2013 | Kiryu et al. | 702/156 |

FOREIGN PATENT DOCUMENTS

| | | |
|---|---|---|
| JP | 05-082208 | 4/1993 |
| JP | 2003-031301 | 1/2003 |

* cited by examiner

*Primary Examiner* — James Harvey
(74) *Attorney, Agent, or Firm* — IPUSA, PLLC

(57) ABSTRACT

A connector includes a first connector and a second connector, wherein the first connector includes first contacts made of a conductive material, and a first movable part made of an insulating material, wherein the first contacts have respective first contact portions of a convex shape, and the first movable part is connected to the first contacts to be movable together with the first contact portions, wherein the second connector includes second contacts made of a conductive material, and a second movable part made of an insulating material, wherein the second contacts have respective second contact portions coming in contact with the first contact portions, and the second movable part is connected to the second contacts to be movable together with the second contact portions, and wherein the first contact portions and the second contact portions are configured to come in contact with each other, thereby establishing electrical coupling.

11 Claims, 12 Drawing Sheets

CONNECTOR

BACKGROUND OF THE INVENTION

1. Field of the Invention

The disclosures herein relate to a connector.

2. Description of the Related Art

Connectors are used to establish electrical connection. A contact of a first connector and a contact of a second connector are brought in contact with each other to establish electrical connection. The first connector may be a plug connector, and the second connector may be a jack connector. The first connector and the second connector are then engaged with each other for electrical connection. In so doing, one or both of the first connector and the second connector may need to be moved in the direction of engaging movement, thereby requiring a certain extent of space for coupling the connectors.

If the space required for connecting the first connector and the second connector with each other can be reduced, the coupling of connectors can be performed in reduced space. When the number of contacts provided on a connector increases, the size of connector also increases, which tends to result in larger space being required for coupling. It is thus desired to reduce the space required for coupling connectors that have a large number of contacts.

Accordingly, it may be preferable to provide connectors each having a plurality of contacts for which coupling can be easily performed while requiring reduced space for coupling the connectors.

[Patent Document 1] Japanese Patent Application Publication No. 5-82208

[Patent Document 2] Japanese Patent Application Publication No. 2003-31301

SUMMARY OF THE INVENTION

According to an embodiment, a connector includes a first connector and a second connector, wherein the first connector includes first contacts made of a conductive material, and a first movable part made of an insulating material, wherein the first contacts have respective first contact portions of a convex shape, and the first movable part is connected to the first contacts to be movable together with the first contact portions, wherein the second connector includes second contacts made of a conductive material, and a second movable part made of an insulating material, wherein the second contacts have respective second contact portions coming in contact with the first contact portions, and the second movable part is connected to the second contacts to be movable together with the second contact portions, and wherein the first contact portions and the second contact portions are configured to come in contact with each other, thereby electrically coupling the first connector and the second connector.

According to at least one embodiment, connectors having a plurality of contacts for which coupling can be easily performed while requiring reduced space for coupling the connectors are provided.

BRIEF DESCRIPTION OF THE DRAWINGS

Other objects and further features of the present invention will be apparent from the following detailed description when read in conjunction with the accompanying drawings, in which.

DESCRIPTION OF THE PREFERRED EMBODIMENTS

In the following, embodiments will be described by referring to the accompanying drawings. The same elements throughout the drawings are referred to by the same numerals, and a description thereof will be omitted.

[First Embodiment]

In the following, a description will be given of a connector according to a first embodiment. The connector of the present embodiment includes a first connector 100 and a second connector 200.

<First Connector>

Figure 1:
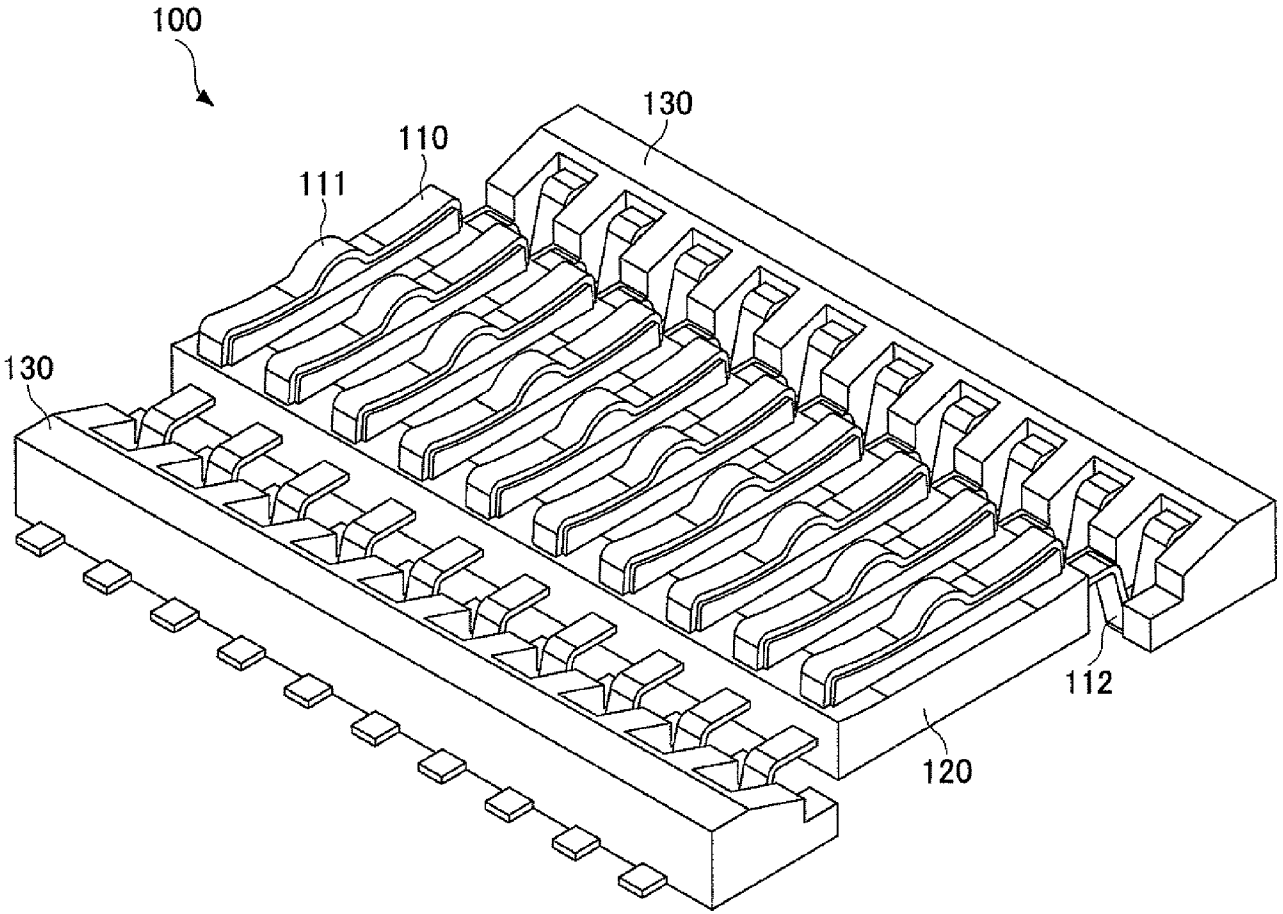
FIG. 1 is an oblique perspective view of a first connector of a first embodiment.
Figure 2:
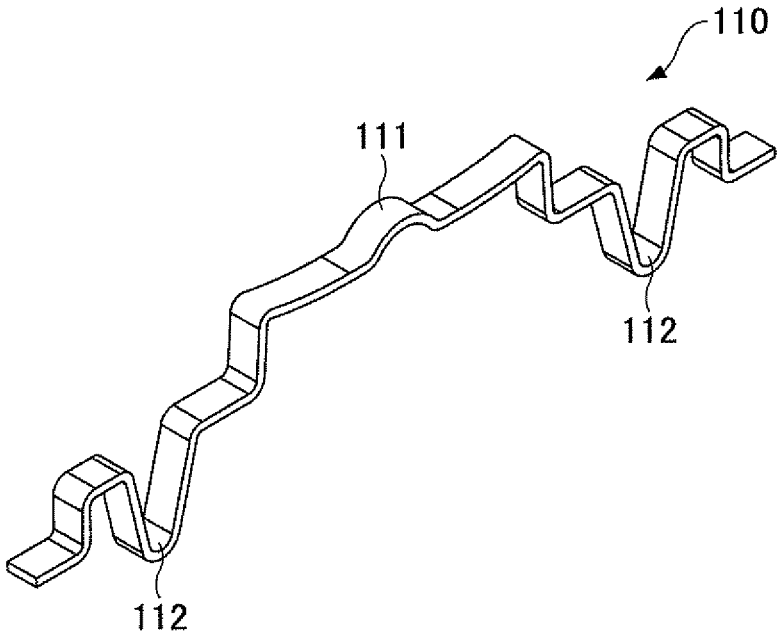
FIG. 2 is an oblique perspective view of a plug contact of the first connector of the first embodiment.

The first connector 100 will be described first. As illustrated in FIG. 1, the first connector 100 includes a plurality of plug contacts 110 arranged in a line. As illustrated in FIG. 2, each plug contact 110 is formed by bending a narrow plate made of an electrically conductive metal material. each plug contact 110 has a plug-side contact portion 111 formed as a convex part (locally raised part) at the center thereof, and also has plug-contact fixing parts 112 each formed as a convex part (locally lowered part) in the proximity of either end.

The plug contacts 110 have a spring property. With the plug-contact fixing parts 112 at both ends being fixed, the plug-side contact portion 111 is configured to move vertically, i.e., in a direction perpendicular to a plate on which the plug contacts 110 are mounted, due to the spring property of the plug contacts 110 at the portions between the plug-contact fixing parts 112 and the plug-side contact portion 111. Specifically, the plug-side contact portion 111 is configured to move substantially in a direction perpendicular to a contact plane that is tangent to the plug-side contact portion 111 at the point where the plug-side contact portion 111 comes in contact with a socket-side contact portion 211, which will be described later.

As illustrated in FIG. 1, the plug contacts 110 are disposed such that the plug-side contact portions 111 are arranged in a line substantially perpendicular to the direction in which each of the plug contacts 110 extends. Each of the plug contacts 110 is connected, between the plug-side contact portion 111 and the plug-contact fixing parts 112, to a plug-side movable part 120 that is formed of an insulating material such as a resin material. The structure made of the plug contacts 110 and the plug-side movable part 120 combined together is formed by arranging the plug contacts 110 at their respective positions and by forming the plug-side movable part 120 using a resin material or the like as an integral part with the plug contacts 110.

The plug-contact fixing parts 112 of each of the plug contacts 110 are fixed to plug-side fixing parts 130 situated at both ends. Specifically, each of the plug contacts 110 is fastened to a printed circuit board or the like serving as a substrate by the plug-side fixing parts 130. With this arrangement, the plug-side contact portions 111 move vertically together with the plug-side movable part 120 due to the spring property of the plug contacts 110. The plug-side fixing parts 130 are made of an insulating material such as a resin material.

<Second Connector>

Figure 3:
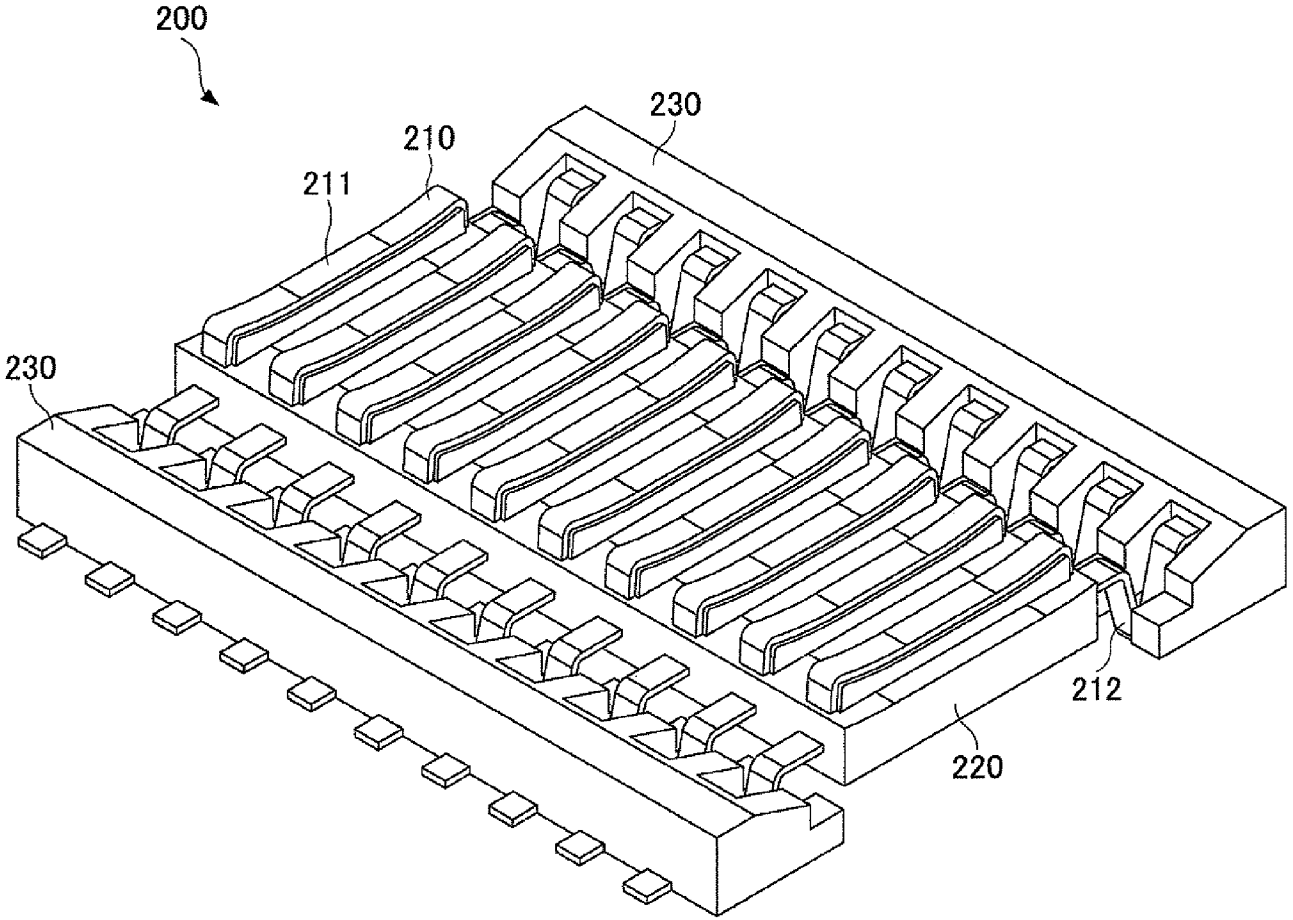
FIG. 3 is an oblique perspective view of a second connector of the first embodiment.
Figure 4:
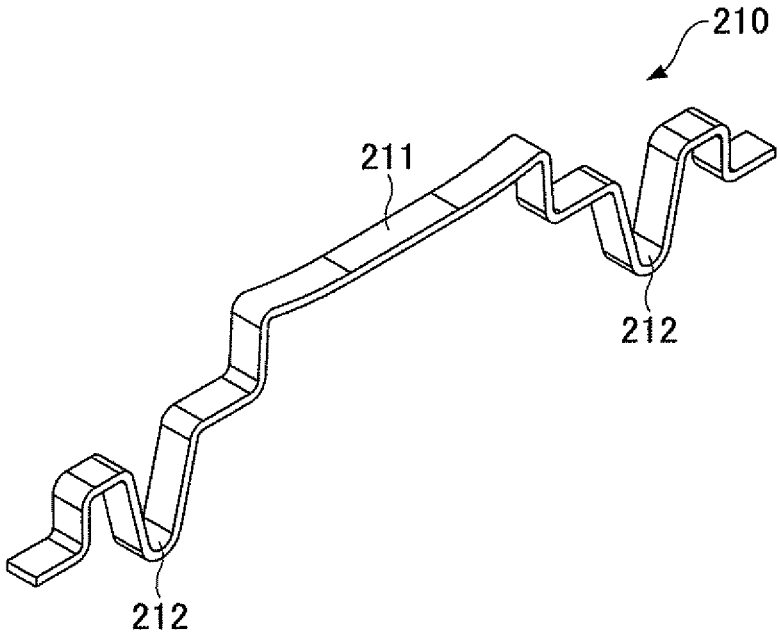
FIG. 4 is an oblique perspective view of a socket contact of the second connector of the first embodiment.

The second connector 200 will be described in the following. As illustrated in FIG. 3, the second connector 200 includes a plurality of socket contacts 210 arranged in a line. As illustrated in FIG. 4, each socket contact 210 is formed by bending a narrow plate made of an electrically conductive metal material. Each socket contact 210 has a socket-side contact portion 211 formed as a substantially flat part at the center thereof, and also has socket-contact fixing parts 212 each formed as a convex part (locally lowered part) in the proximity of either end.

The socket contacts 210 have a spring property. With the socket-contact fixing parts 212 at both ends being fixed, the socket-side contact portion 211 is configured to move vertically, i.e., in a direction perpendicular to a plate on which the socket contacts 210 are mounted, due to the spring property of the socket contacts 210 at the portions between the socket-contact fixing parts 212 and the socket-side contact portion 211. Specifically, the socket-side contact portion 211 is configured to move substantially in a direction perpendicular to a contact plane that is tangent to the socket-side contact portion 211 at the point where the socket-side contact portion 211 comes in contact with the plug-side contact portion 111.

As illustrated in FIG. 3, the socket contacts 210 are disposed such that the socket-side contact portions 211 are arranged in a line substantially perpendicular to the direction in which each of the socket contacts 210 extends. Each of the socket contacts 210 is connected, between the socket-side contact portion 211 and the socket-contact fixing parts 212, to a socket-side movable part 220 that is formed of an insulating material such as a resin material. The structure made of the socket contacts 210 and the socket-side movable part 220 combined together is formed by arranging the socket contacts 210 at their respective positions and by forming the socket-side movable part 220 using a resin material or the like as an integral part with the socket contacts 210.

The socket-contact fixing parts 212 of each of the socket contacts 210 are fixed to socket-side fixing parts 230 situated at both ends. Specifically, each of the socket contacts 210 is fastened to a printed circuit board or the like serving as a substrate by the socket-side fixing parts 230. With this arrangement, the socket-side contact portions 211 move vertically together with the socket-side movable part 220 due to the spring property of the socket contacts 210. The socket-side fixing parts 230 are made of an insulating material such as a resin material.

<Coupling of Connectors>

Figure 5:
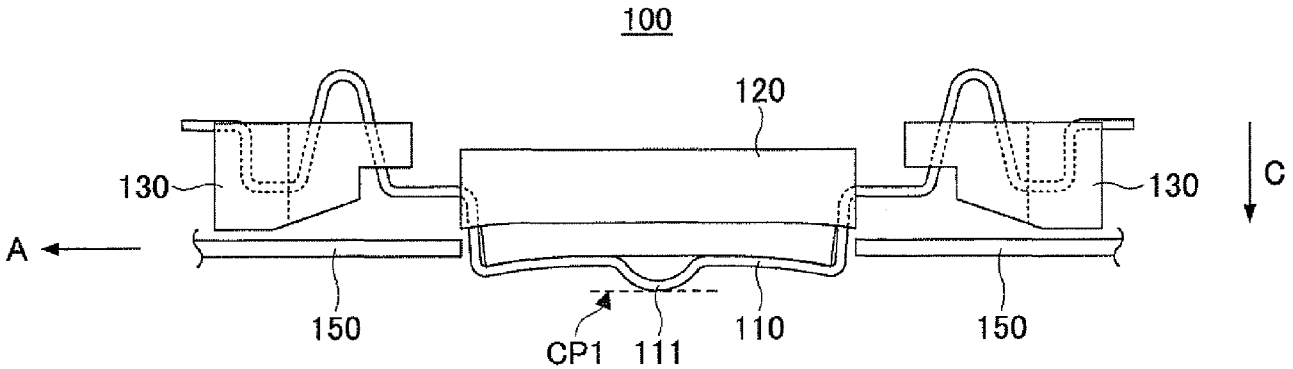
FIG. 5 is a drawing illustrating the first connector of the first embodiment.
Figure 6:
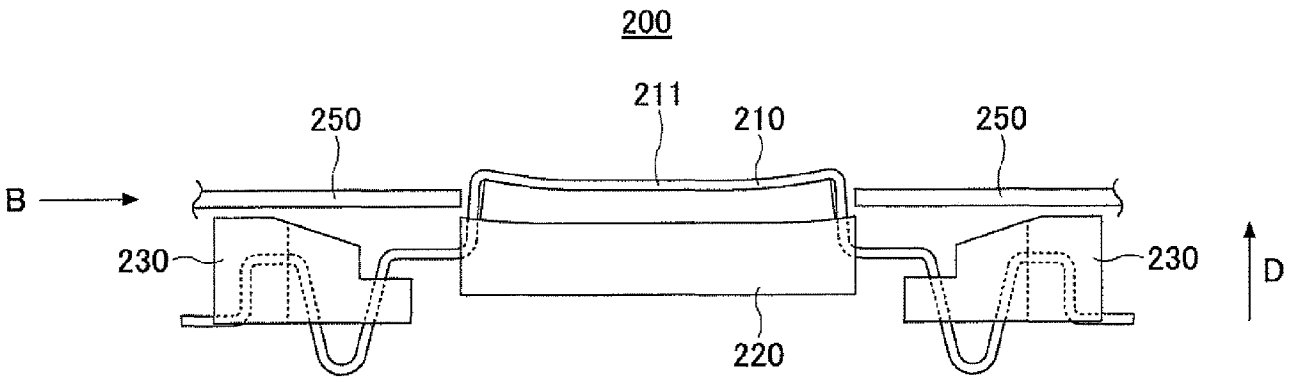
FIG. 6 is a drawing illustrating the second connector of the first embodiment.

According to the present embodiment, as illustrated in FIG. 5, the first connector 100 is configured such that the plug-side contact portions 111 of the plug contacts 110 project from a housing member 150. As illustrated in FIG. 6, further, the second connector 200 is configured such that the socket-side contact portions 211 of the socket contacts 210 project from a housing member 250. With such arrangements, the movement of bringing the housing member 150 of the first connector 100 closer to the housing member 250 of the second connector 200 results in the plug-side contact portions 111 of the plug contacts 110 coming in contact with the socket-side contact portions 211 of the socket contacts 210, thereby establishing electrical coupling. In so doing, coupling between the first connector 100 and the second connector 200 can be established through sliding movement by moving the first connector 100 in a direction indicated by an arrow A and/or by moving the second connector 200 in a direction indicated by an arrow B. Generally, coupling would be established by moving the first connector 100 in a direction indicated by an arrow C and/or by moving the second connector 200 in a direction indicated by an arrow D. In the case of such coupling movement, large space would be required in order to couple the first connector 100 to the second connector 200. In the case of the connectors of the present embodiment, on the other hand, coupling is established by moving the first connector 100 in the direction indicated by the arrow A and/or by moving the second connector 200 in the direction indicated by the arrow B. Because of this, the extent of space required for coupling the first connector 100 to the second connector 200 is reduced. It may be noted that both the direction indicated by the arrow A and the direction indicated by the arrow B are parallel to a contact plane CP1 (FIG. 5) that is tangent to the plug-side contact portion 111 and the socket-side contact portion 211 at a point at which the plug-side contact portion 111 and the socket-side contact portion 211 come in contact with each other.

Through such movement, the plug-side contact portions 111 of the plug contacts 110 slide on the surfaces of the socket contacts 210, thereby removing dusts and corrosive substances from these surfaces. This ensures that electrical connection be reliably established between the plug contacts 110 and the socket contacts 210.

[Second Embodiment]

Figure 7:
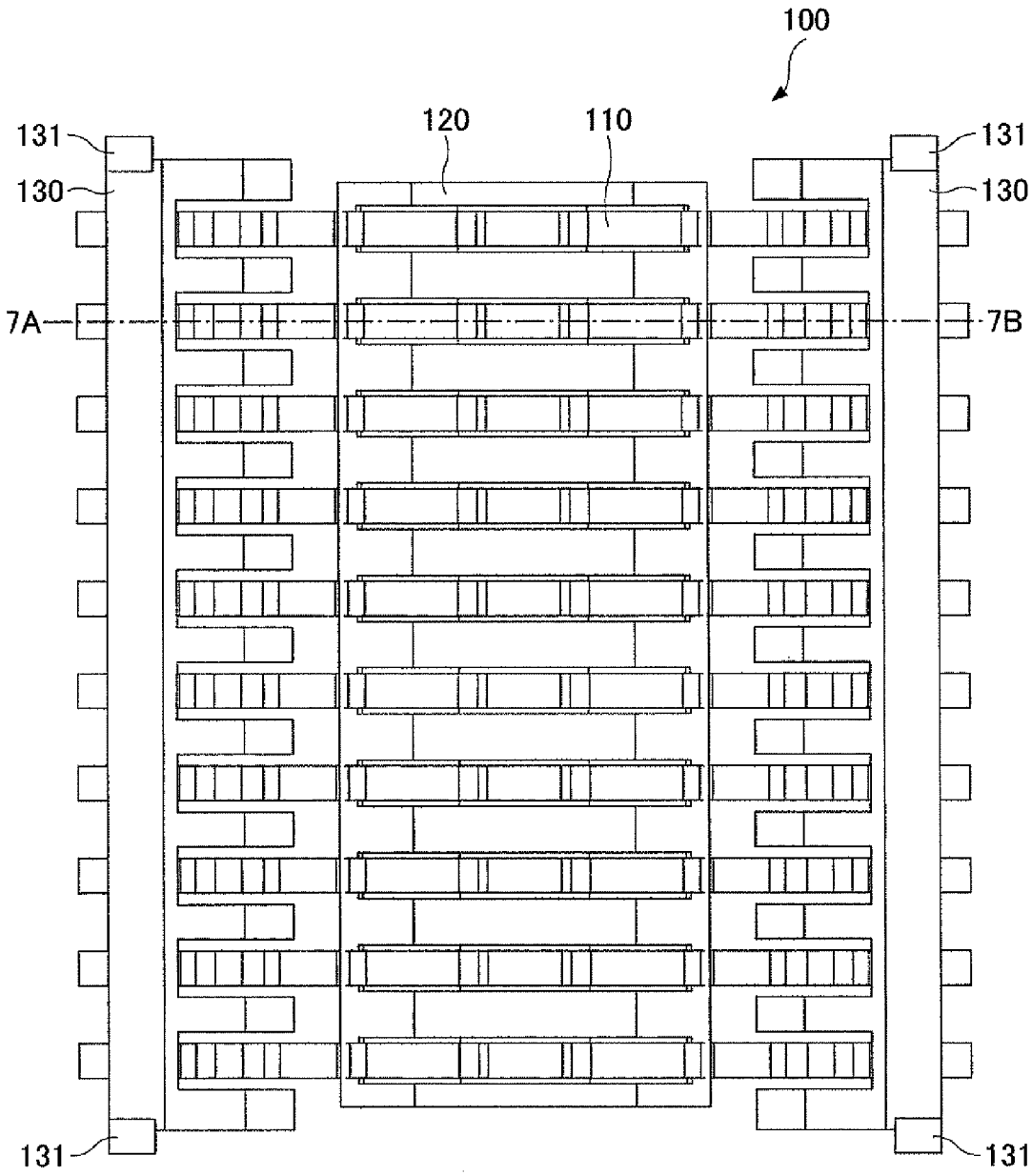
FIG. 7 is a plan view of a first connector of a second embodiment.
Figure 8:
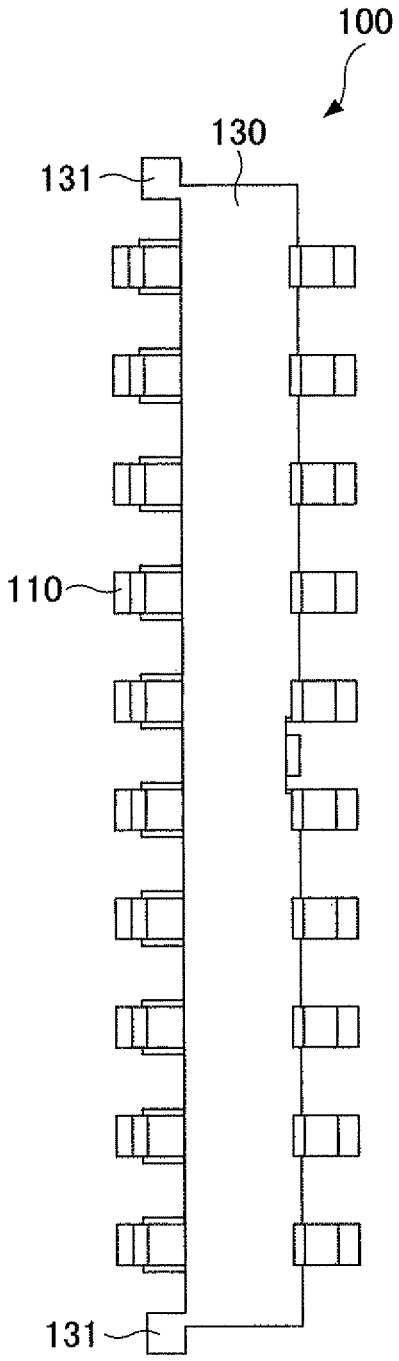
FIG. 8 is a lateral view of the first connector of the second embodiment.
Figure 9:
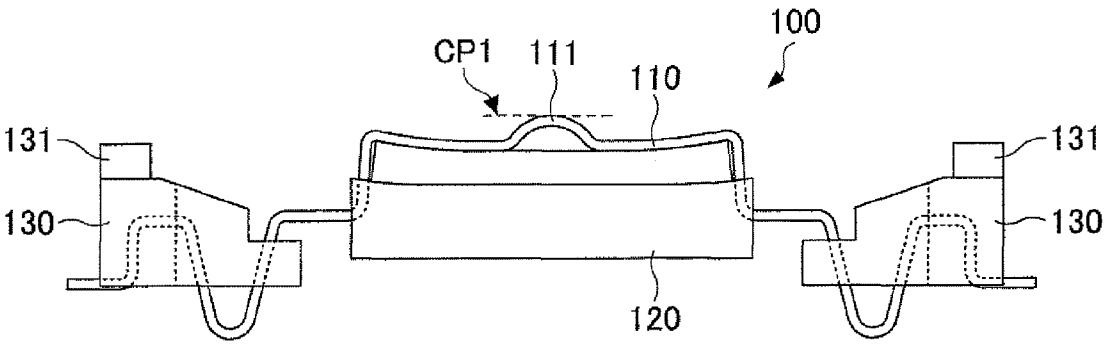
FIG. 9 is a front view of the first connector of the second embodiment.
Figure 10:
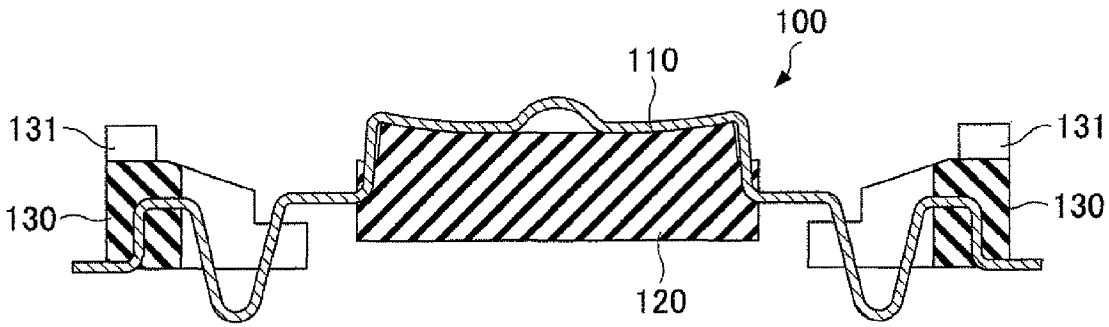
FIG. 10 is a cross-sectional view of the first connector of the second embodiment.
Figure 11:
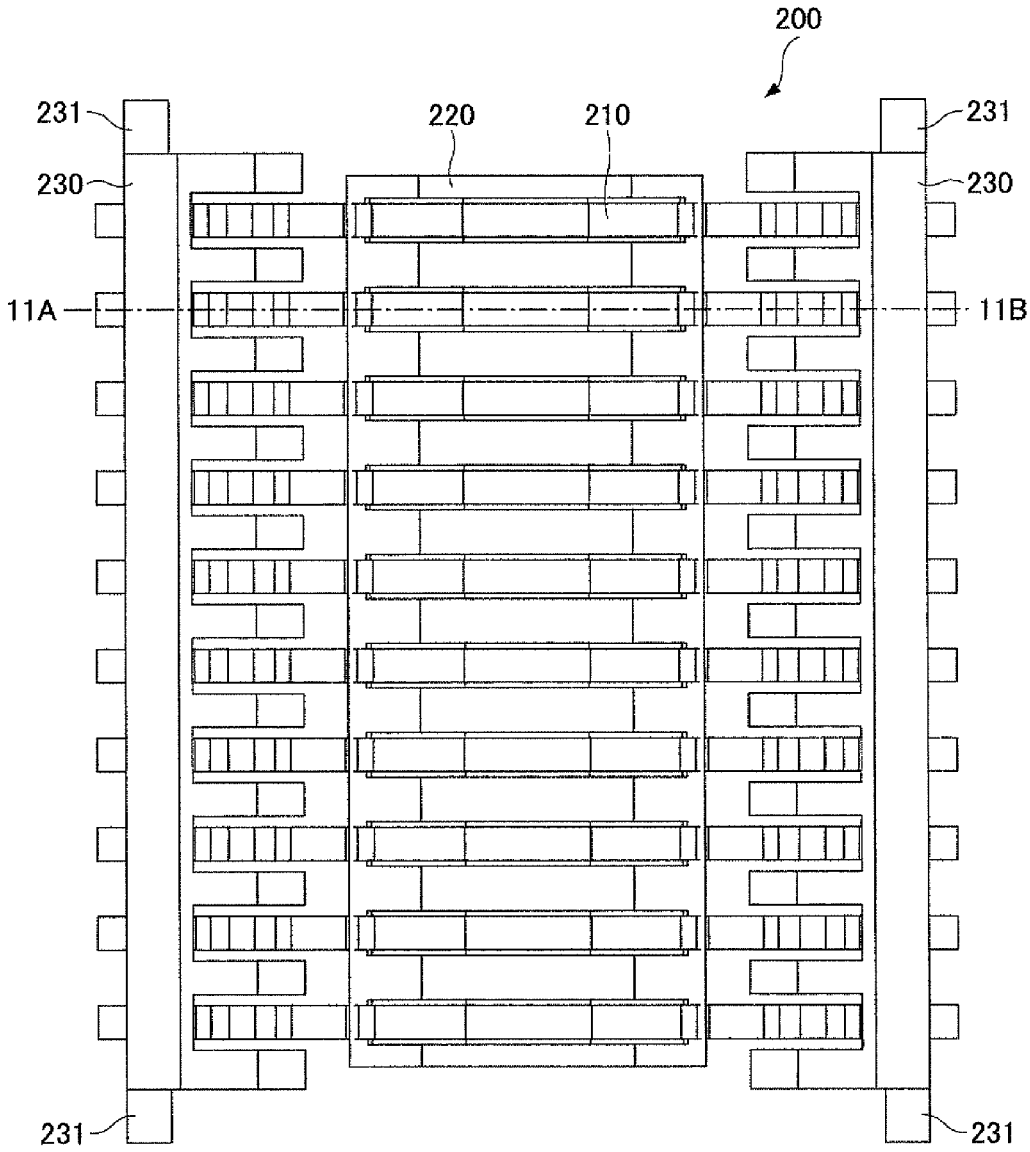
FIG. 11 is a plan view of a second connector of the second embodiment.
Figure 12:
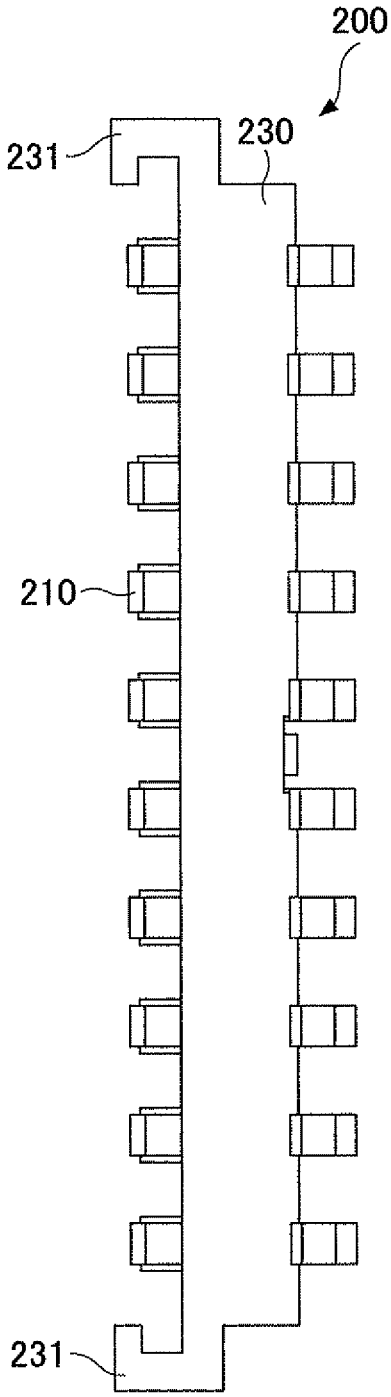
FIG. 12 is a lateral view of the second connector of the second embodiment.
Figure 13:
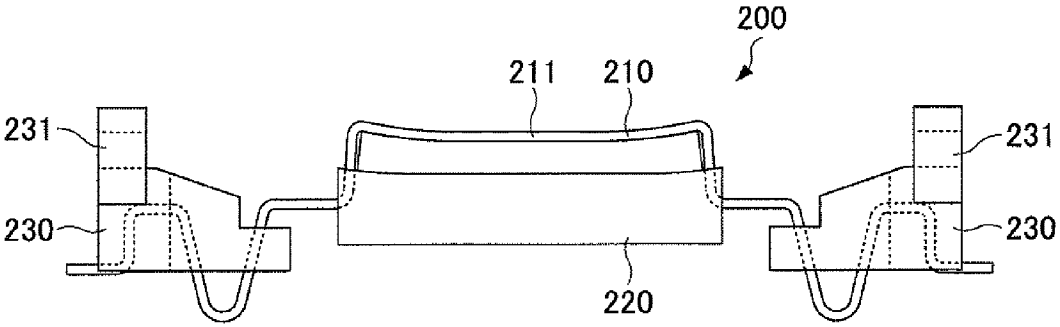
FIG. 13 is a front view of the second connector of the second embodiment.
Figure 14:
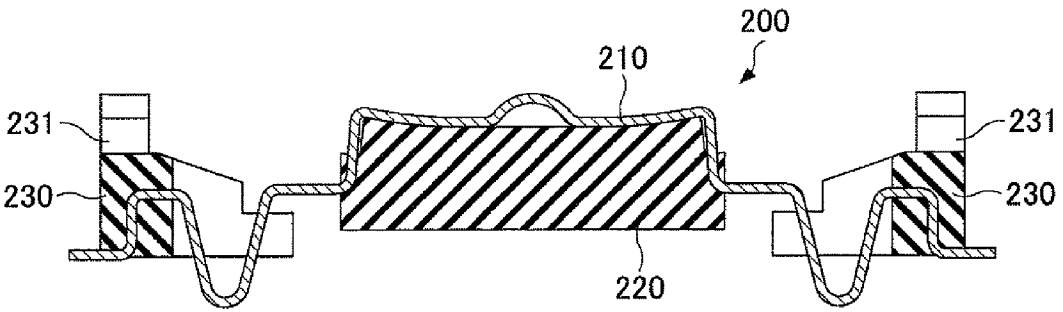
FIG. 14 is a cross-sectional view of the second connector of the second embodiment.

In the following, a second embodiment will be described. The present embodiment is directed to a configuration in which guides are provided to assist sliding movement of the first connector 100 and/or the second connector 200. Specifically, as illustrated in FIG. 7 and FIG. 8, plug-side guides 131 having a convex shape are provided at the opposite ends of each of the plug-side fixing parts 130 of the first connector 100. Further, as illustrated in FIG. 11 and FIG. 12, socket-side guides 231 having a shape which complements the shape of the plug-side guides 131 are provided at the opposite ends of each of the socket-side fixing parts 230 of the second connector 200. It may be noted that FIG. 7 is a plan view of the first connector 100 of the present embodiment, and FIG. 8 is a lateral view thereof. Further, FIG. 9 is a front view of the first connector 100, and FIG. 10 is a cross-sectional view taken along the chain line 7A-7B shown in FIG. 7. Moreover, FIG. 11 is a plan view of the second connector 200 of the present embodiment, and FIG. 12 is a lateral view thereof. FIG. 13 is a front view of the second connector 200, and FIG. 14 is a cross-sectional view taken along the chain line 11A-11B shown in FIG. 11.

<Coupling of Connectors>

Figure 15:
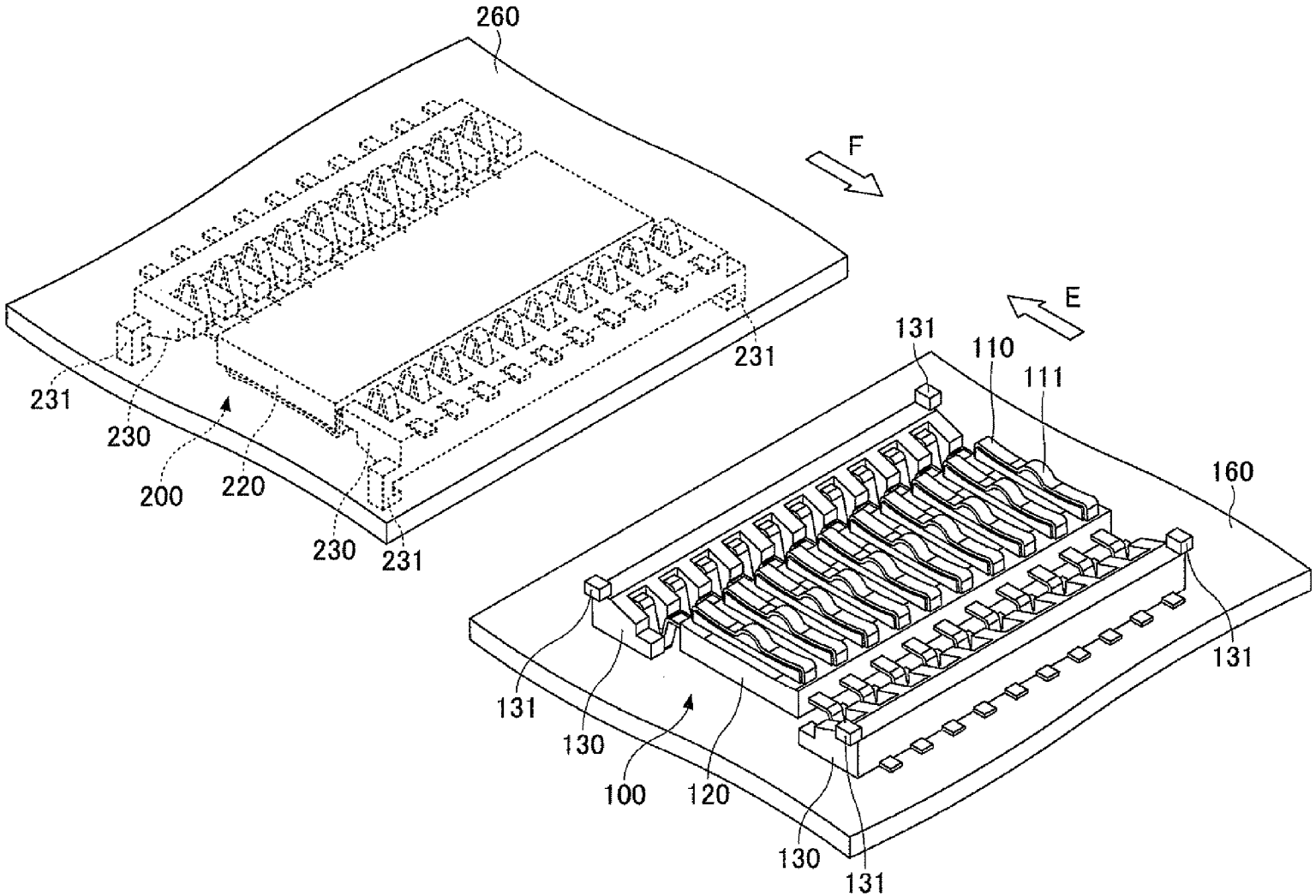
FIG. 15 is a drawing illustrating a method of coupling the connectors of the second embodiment.

In the following, a method of coupling connectors according to the present embodiment will be described. According to the present embodiment, as illustrated in FIG. 15, the first connector 100 is fixed to a printed circuit board 160 by the plug-side fixing parts 130. The second connector 200 is fixed to a printed circuit board 260 by the socket-side fixing parts 230.

In such a configuration, the plug-side contact portions 111 of the first connector 100 are arranged substantially in parallel to the printed circuit board 160. Also, the socket-side contact portions 211 of the second connector 200 are arranged substantially in parallel to the printed circuit board 260. With this arrangement, coupling between the first connector 100 and the second connector 200 can be established by moving the first connector 100 in a direction indicated by an arrow E and/or by moving the second connector 200 in a direction indicated by an arrow F. Namely, coupling can be established by moving at least one of the first connector 100 and the second connector 200 in substantially parallel to the printed circuit board 160 and the printed circuit board 260, respectively. It may be noted that both the direction indicated by the arrow E and the direction indicated by the arrow F are parallel to the contact plane CP1 (FIG. 9) that is tangent to the plug-side contact portion 111 and the socket-side contact portion 211 at a point at which the plug-side contact portion 111 and the socket-side contact portion 211 come in contact with each other.

In the present embodiment, further, sliding movement for establishing coupling is performed such that the plug-side guides 131 situated at both ends of each of the plug-side fixing parts 130 of the first connector 100 fit into the socket-side guides 231 situated at both ends of each of the socket-side fixing parts 230 of the second connector 200. This arrangement ensures that the plug contacts 110 and the socket contacts 210 are reliably connected to each other.

Configurations other than those described above are the same as or similar to those of the first embodiment.

Further, although a pair of connectors each having a plurality of contacts for which coupling can be easily performed has been described by referring to the embodiments disclosed herein, the present invention is not limited to these embodiments, but various variations and modifications may be made without departing from the scope of the present invention.

The present application is based on Japanese priority application No. 2011-144952 filed on Jun. 29, 2011, with the Japanese Patent Office, the entire contents of which are hereby incorporated by reference.

What is claimed is:

1. A connector, comprising:

a first connector; and a second connector, wherein the first connector includes:

a plurality of first contacts made of a conductive material; and a first movable part made of an insulating material, wherein the first contacts have respective first contact portions of a convex shape, and the first movable part is connected to the first contacts to be movable together with the first contact portions, wherein the second connector includes:

a plurality of second contacts made of a conductive material; and a second movable part made of an insulating material, wherein the second contacts have respective second contact portions coming in contact with the first contact portions, and the second movable part is connected to the second contacts to be movable together with the second contact portions, wherein the first contact portions and the second contact portions are configured to come in contact with each other,and wherein the first movable part is movable relative to ends of the first contacts, and the second movable part is movable relative to ends of the second contacts.

2. A connector, comprising:

a first connector; and a second connector, wherein the first connector includes:

a plurality of first contacts made of a conductive material; and a first movable part made of an insulating material, wherein the first contacts have respective first contact portions of a convex shape, and the first movable part is connected to the first contacts to be movable together with the first contact portions, wherein the second connector includes:

a plurality of second contacts made of a conductive material; and a second movable part made of an insulating material, wherein the second contacts have respective second contact portions coming in contact with the first contact portions, and the second movable part is connected to the second contacts to be movable together with the second contact portions, and wherein the first contact portions and the second contact portions are configured to come in contact with each other, wherein the first connector includes two first fixing parts, one ends of the first contacts being fixed to one of the first fixing parts, and the other ends of the first contacts being fixed to the other one of the first fixing parts, a respective one of the first contact portions being formed at a center of a corresponding one of the first contacts, and wherein the second connector includes two second fixing parts, one ends of the second contacts being fixed to one of the second fixing parts, and the other ends of the second contacts being fixed to the other one of the second fixing parts, a respective one of the second contact portions being foinied at a center of a corresponding one of the second contacts.

3. The connector as claimed in claim 2, wherein the first fixing parts have first guides, and the second fixing parts have second guides, and wherein the first guides are engaged with the second guides upon coupling the first connector and the second connector.

4. The connector as claimed in claim 2, wherein the first connector is fastened to a first substrate by the first fixing parts, and the second connector is fastened to a second substrate by the second fixing parts.

5. The connector as claimed in claim 1, wherein the first movable part and the second movable part are movable in a direction perpendicular to a contact plane that is tangent to the first contact portions and the second contact portions at points at which the first contact portions and the second contact portions come in contact with each other, and wherein at least one of the first connector and the second connector is moved in parallel to the contact plane to bring the first contact portions and the second contact portions in contact with each other.

6. The connector as claimed in claim 5, wherein each of the first contacts of the first connector extends in a direction in which the at least one of the first connector and the second connector is moved, and each of the second contacts of the second connector extends in the direction in which the at least one of the first connector and the second connector is moved.

7. The connector as claimed in claim 6, wherein the first contacts of the first connector are disposed such that the first contact portions are arranged in a line perpendicular to the direction in which the at least one of the first connector and the second connector is moved.

8. The connector as claimed in claim 3, wherein the first movable part and the second movable part are movable in a direction perpendicular to a contact plane that is tangent to the first contact portions and the second contact portions at points at which the first contact portions and the second contact portions come in contact with each other, and wherein at least one of the first connector and the second connector is moved in parallel to the contact plane to engage the first guides and the second guides with each other.

9. The connector as claimed in claim 3, wherein the first connector and the second connector is moved relative to each other, in a direction in which each of the first contacts and each of the second contacts extends, and wherein the first guides and the second guides are engaged with each other by a movement that moves the first connector and the second connector relative to each other in the direction in which each of the first contacts and each of the second contacts extends.

10. A connector, comprising:

a first connector that includes:

a first contact made of a conductive material, to be fixed to a first substrate at both end portions thereof, and having a first contact portion at a middle portion thereof; and a first movable part made of an insulating material which is connected to the first contact to be movable together with the first contact portion relative to the first substrate; and a second connector connectable to the first connector, the second connector including:

a second contact made of a conductive material, to be fixed to a second substrate at both end portions thereof, and having a second contact portion at a middle portion thereof that comes in contact with the first contact portion when the second connector is connected to the first connector; and a second movable part made of an insulating material which is connected to the second contact to be movable together with the second contact portion relative to the second substrate;

wherein the first contact and the second contact come in contact with each other by moving the first connector relative to the second connector in a direction parallel to the first substrate and the second substrate.

11. The connector as claimed in claim 10, wherein the first connector includes a plurality of first contacts that are arranged in parallel to each other and are connected to the first movable part, and wherein the second connector includes a plurality of second contacts that are arranged in parallel to each other and are connected to the second movable part.

* * * * *